US005943845A

United States Patent [19]

Ilsemann

[11] Patent Number: 5,943,845

[45] Date of Patent: Aug. 31, 1999

[54] PROCESS AND DEVICE FOR THE PACKAGING OF COMPACT DISCS

[75] Inventor: Heino Ilsemann, Bremen, Germany

[73] Assignee: Heino Ilsemann Verpackungsmachinen-Vertriebs-GmbH & Co., Bremen, Germany

[21] Appl. No.: 08/833,762

[22] Filed: Apr. 9, 1997

[30] Foreign Application Priority Data

Apr. 9, 1996 [DE] Germany ..... 196 13 832

[51] Int. Cl.[6] ..... B65B 7/26; B65B 43/38

[52] U.S. Cl. ..... 53/468; 53/474; 53/484; 53/238; 53/254; 53/377.6

[58] Field of Search ..... 53/474, 484, 445, 53/468, 155, 238, 240, 254, 377.6

[56] References Cited

FOREIGN PATENT DOCUMENTS 35 36 509 1/1988 Germany .

35 46 552 12/1988 Germany .

32 39 378 2/1989 Germany .

*Primary Examiner*—John Sipos

*Attorney, Agent, or Firm*—Merchant & Gould P.C.

[57] ABSTRACT

Process for packaging compact discs (CD's) in CD boxes, in which process a CD box, with a lower side and a lid held thereon in a swingable fashion, is opened, a booklet is inserted into lid of the box, and the box is closed by a swinging back of the lid, characterized hereby, that the booklet and the lid are temporarily pressed firmly against each other during the swinging back of the lid, so that a slipping of the booklet with respect to the lid during the closing is prevented, as well as a device, in particular for carrying out such a process.

25 Claims, 3 Drawing Sheets

Position 0°

Position -5°

Position 167,5°

Position 10°

PROCESS AND DEVICE FOR THE PACKAGING OF COMPACT DISCS

Figure 1:
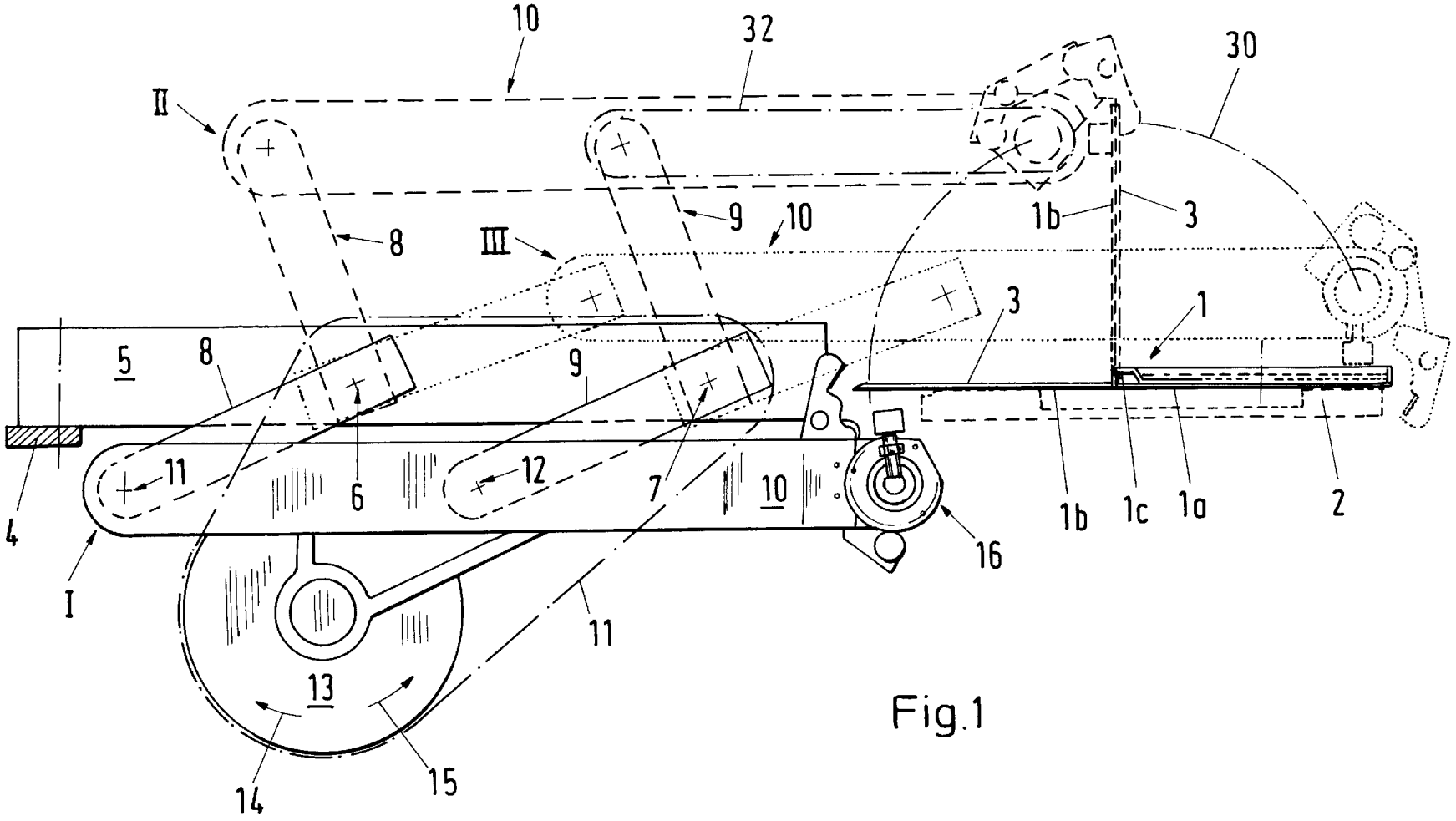

The invention deals with a process for the packaging of compact discs (CD's) in CD boxes, in which process a CD box, with a lower side and a lid held thereon in a swingable fashion, is opened, a booklet is inserted into the lid, and the box is closed by a swinging back of the lid. The invention deals further with a device for the packaging of compact discs (CD's) in CD boxes, in particular for implementing the process according to the invention, with equipment for opening the CD boxes that show a lower side and a lid held thereon in a swingable fashion, with equipment for inserting a booklet into the lid and with equipment for closing the box by a swinging back of the lid.

In known processes and devices applied at present in the packaging industry for the packaging of CD's in the conventional containers consisting mostly of clear plastic (CD boxes), the packaging process is divided into a series of steps. First, the empty CD boxes, consisting of a lower part and a swingable upper part or lid attached to the lower part in an articulated manner, are supplied one after another. This generally takes place in the form of a stack of boxes essentially arranged vertically. The boxes are removed from the stack one after another and brought into a horizontal position, the lid being located at the top. Subsequently the box is opened by swinging up the lid, with the lower part remaining in its position and the lid typically being swung up to at least 60° with respect to the horizontal. Depending on the chosen sequence of the following operations, the lid may be swung up to as far as 180°.

After an opened box is made available in the described manner, on the one hand the so-called inlay card, the CD-carrying insert part called the tray, as well as the CD itself are in this order laid or set into the lower part. On the other hand, the lid of the box stands ready to receive the booklet. After the insertion of the booklet consisting of one or several leaves, in a concluding step the lid, together with the booklet being held loosely in it behind projections, is swung back and the CD box is thus closed.

Because of the fact that the lid is attached to the lower part so as to be swingable, and that consequently the closing process unavoidably consists of a swinging or rotating motion, during the closing of the box the problem usually arises of the booklet slipping with respect to the lid during the swinging operation. This has the result that either the booklet slips downward by virtue of its weight, i.e. in the direction of the articulated joint of the lid and lower part, when the lid is in an essentially vertical position, or else the booklet is thrown out of the lid to some extent due to centrifugal force during a rapid closing movement. As a consequence of this, the CD box can no longer be completely closed afterwards, which is disadvantageous and can entail disruptions in the further course of operations Different measures have been proposed to avoid such a displacement of the booklet with respect to the lid. First of all, situated on the inside of the lid are rounded-off projections that to a certain degree prevent a shifting of the booklet inside the lid. This solution has certainly proved to be insufficient. It has been further proposed that the booklet be rolled, creased, folded, or the like, before insertion into the lid, in order to attain a better interaction between the lateral edges of the booklet and the mentioned projections. Nevertheless, even disregarding implementation problems, in particular with multiple-page booklets such a measure has likewise proved to be inadequate. Thus there continues to exist a need for another possibility of suitably protecting the booklets against slipping out during the closing process.

Therefore, the problem of the invention consists in developing and improving the process and device mentioned at the beginning in such a manner that the booklets, after insertion into the lid, are protected from falling out or slipping during the closing process.

According to the invention, this problem of the development of the generic process is solved by the fact that the booklet and the lid are temporarily pressed firmly against each other during the swinging back of the lid, so that a sliding of the booklet with respect to the lid is prevented during the closing.

In this, provision can be made for pressing the booklet against the lid by pneumatic means.

Further, the invention provides for pressing the booklet against the lid by mechanical means.

Also, the invention proposes the pressing of the booklet against the lid by means of a gripper.

In addition, it is proposed that the mechanical pressing of the booklet against the lid takes place under magnetic influence, preferably electromagnetic influence.

The invention also provides for the electrostatic charging of the booklet and/or the lid, so that the resulting electrostatic attractive force presses the bottom and lid firmly to each other.

It is further planned that the booklet and/or the lid be electrostatically charged before the insertion of the booklet into the lid.

In the device category, the above-stated problem of development of the generic device is solved through means for the temporary, firm pressing together of the booklet and lid while they are swinging back, so that during the closing a sliding of the booklet with respect to the lid is prevented.

A particular implementation form of this can be characterized by a pneumatic arrangement for pressing together the booklet and lid.

A further implementation form is characterized by mechanical means for pressing together the booklet and lid.

Here, the invention can be characterized by a gripper.

The invention is further characterized by a magnetic arrangement, preferably an electromagnetic arrangement, for mechanically pressing together the booklet and lid.

According to the invention, it is planned that during the closing, the gripper is guided along a circular course around the swing axis of the lid.

The invention further provides for the gripper being held on a support arm that is guided on two parallel swing arms in the manner of a parallelogram, with the gripper moving along the circular course.

A further implementation form of the invention proposes that the gripper be held on the support arm so as to be swingable.

A special implementation form is characterized by a coupling arrangement between one swing arm and the gripper, for an automatic coupling of the swing position of the gripper to the position of the swing arm.

Here, the invention is characterized by an arrangement for the control of the gripping function of the gripper in dependence upon its swing position relative to the support arm.

The invention is additionally characterized by a cam disc and a cam follower.

A further implementation form is characterized by equipment for electrostatically charging the booklet.

In addition, the invention is characterized by a comb-like electrode arrangement for charging the booklet, over which the booklet is to move during insertion into the lid.

Finally, the invention is characterized by equipment for electrostatically charging the lid.

Forming the basis of the invention is the recognition that the friction between booklet and lid can be best utilized to solve the problem, i.e. to prevent the booklet from shifting with respect to the lid, when the booklet is pressed firmly against the lid.

If, in conjunction with the fact that the gripper is held on the support arm so as to be swingable, provision is made for a coupling arrangement between the swing arm and the gripper for forced coupling of the swing position of the gripper and the position of the swing arm, then a precise orientation of the gripper relative to the lid can be attained during the closing process, for example an unchanging orientation.

Moreover, if, as is planned in a special implementation form of the invention, provision is made for an arrangement for control of the gripping function of the gripper depending upon its swing position relative to the support arm, which arrangement can suitably include a cam disc and a cam follower, then it becomes possible for the gripper to begin to grip upon moving into a particular swing position (e.g. at the beginning of the closing process), and to again let go upon crossing a further swing position (e.g. at the end of the swing process).

Further features and advantages of the invention are revealed in the following description, in which an implementation example is explained in detail with the aid of the drawings.

Shown therein are:

FIG. 1 a schematic side view of a part of an arrangement for packaging CD's, in which arrangement the closing of the CD box is performed; and FIG. 2–5 the structure and manner of functioning of a gripper, as it is applied in the device according to FIG. 1.

FIG. 1 illustrates in greatly schematized representation a possible form of a device according to the invention. The represented device is to be seen as part of a complete packaging unit in which additional equipment is present for the feeding and opening of the empty CD boxes, for the insertion of the booklet into the lid, and, if need be, for further processes. For the purpose of representation and for the solution of the problem of the invention, it is of no consequence whether the mentioned stations, or rather, pieces of equipment are arranged in linear succession or in circular fashion, and how this other equipment operates in detail.

In the representation in FIG. 1, it is simply assumed that a CD box 1 opened to 180° with a lower part 1*a* and lid 1*b* is prepared or supplied. The open CD box rests horizontally upon a carrier 2, for example a conveyer belt. The lower part 1*a* is at this stage already fitted with the inlay card, the CD tray, and the CD itself. A booklet 3 lies on the lid, or rather is slipped in between the lid and the retaining projections (not illustrated) situated on the lid. Thus, for the completion of the process of packaging the CD in the box, only the closing of the lid is still lacking, in which the lid is swung around the point of articulation, or rather the hinge 1*c*, on the lower part and comes to rest upon the lower part, closing it up.

FIG. 1 shows the position of the device in three successive phases, I. to III., of the closing process, with the relevant parts represented by solid, dashed, and dotted lines.

For explanation of the fundamental mechanical structure of the device, for the time being reference will be made exclusively to the device parts represented by solid lines (phase I). A carrier 5 is held in a suitable fashion on a support frame 4. A first swing arm 8 is held at one end section on the carrier 5 so as to rotate around a horizontal axis 6 that is perpendicular to the plane of representation. In a corresponding manner, a second swing arm 9 is held so as to swing around a second axis 7, and is orientated parallel to the first swing arm. The two swing arms carry a support arm 10 on their other ends, provision being made in like manner for bearings with horizontal axes of rotation 11, 12. From the parallelogram-like structure of this quadruply-articulated system it is evident that the support arm 10 is positioned for an overall circular movement, whereby its orientation with respect to the carrier 5 does not change, i.e. the support arm 10 always remains horizontal. The movement of the support arm 10 is here controlled through a driven toothed belt 11 or the like, which on the one hand runs through a drive wheel 12 that is drivable in both directions, and on the other hand runs through belt pulleys, not represented, whose axes of rotation coincide with the swing axes 6, 7 and which are firmly attached to the swing arms 8 and 9, respectively. If the drive wheel 13 is rotated clockwise (arrow 14) by a motor or the like, then the rollers rotating around the axes 6, 7 are likewise put into clockwise rotation, and the swing arms 8, 9 move the support arm 10 out of position I, represented by solid lines, upward for the time being. The reverse is true for a driving in the opposite direction (arrow 15).

Held on the support arm 10 end section turned towards the CD box is a gripper, indicated as a whole by reference numeral 16, whose construction and manner of functioning will be explained with reference to FIGS. 2 through 5.

A gripper body 18 held on a rotatable shaft 17 carries on one side a stationary support 19 and on the other a gripper arm 21 swingable around an axis 20. The end section shaped for gripping, situated above in FIG. 2, of the gripper arm 21 as well as the support 19 are provided with a soft surface layer, in order to avoid a scratching of delicate surfaces. The opposite end section of the gripper arm 21 serves as the operating arm, on which the rotating roller 22 is held.

Figure 2:
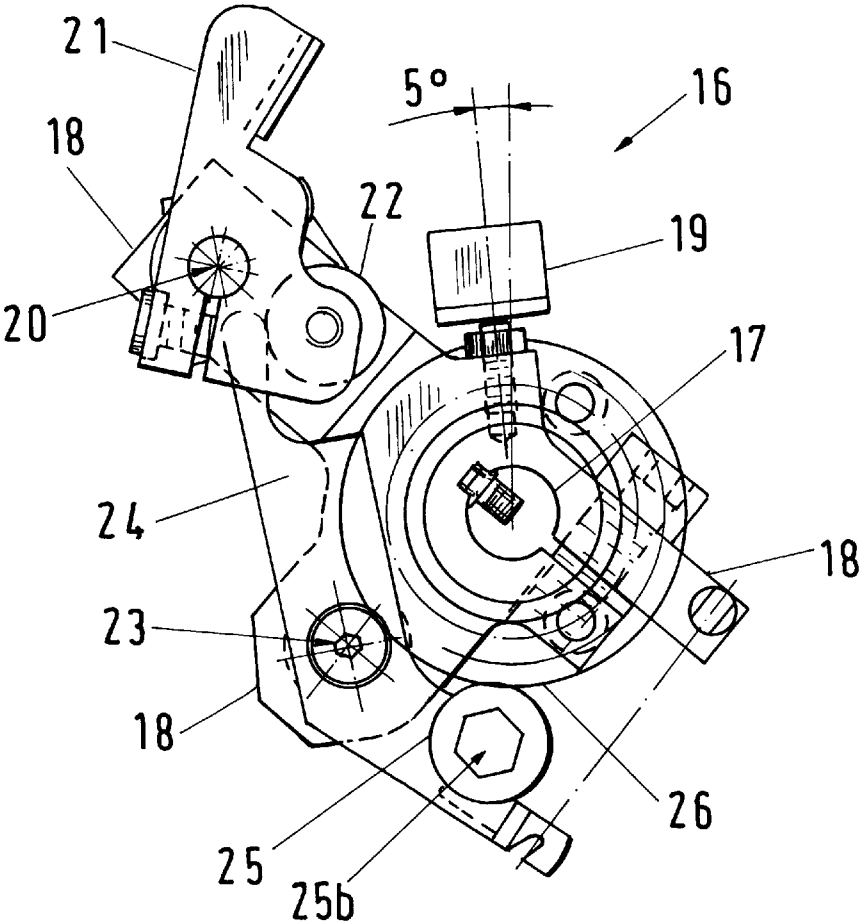

As FIG. 2 further shows, a tipping arm 24 swingable around an axis 23 is held on the gripper body 18. The lower end-section of the tipping arm 24, turned away from the gripper arm 21, carries an additional roller 25 that rotates around an axis 25*b* and rolls with its outside against a cam disc 26. The other end section of the tipping arm 24, turned towards the gripper arm 21, touches the roller 22 of the gripper arm 21 on its outside. The gripper arm 21 is pre-tensioned in the gripping direction, i.e. clockwise in FIGS. 2 through 5, by means of a spring, not depicted, with the spring force transferred via the roller 22, the tipping arm 24, and the roller 25 to the cam disc 26.

For elucidation of the functioning of the gripper, reference will be made to FIGS. 1 and 2 jointly. Upon a turning of the drive wheel 13 in a clockwise direction, the support arm 10, starting out from the position I. already commented upon (solid lines), passes through position II. (dashed lines), shifted approximately 90° from position I., and finally reaches position III. (dotted lines), which is again shifted about 90° from the previous position and essentially corresponds to the closed position of the lid 1*b*, as is evident from the drawing. During this, the gripper 16 held on the support arm 10, or rather the middlepoint of its shaft 17, follows the half-circular course of movement 30 indicated by a dot-dash line.

Figure 3:
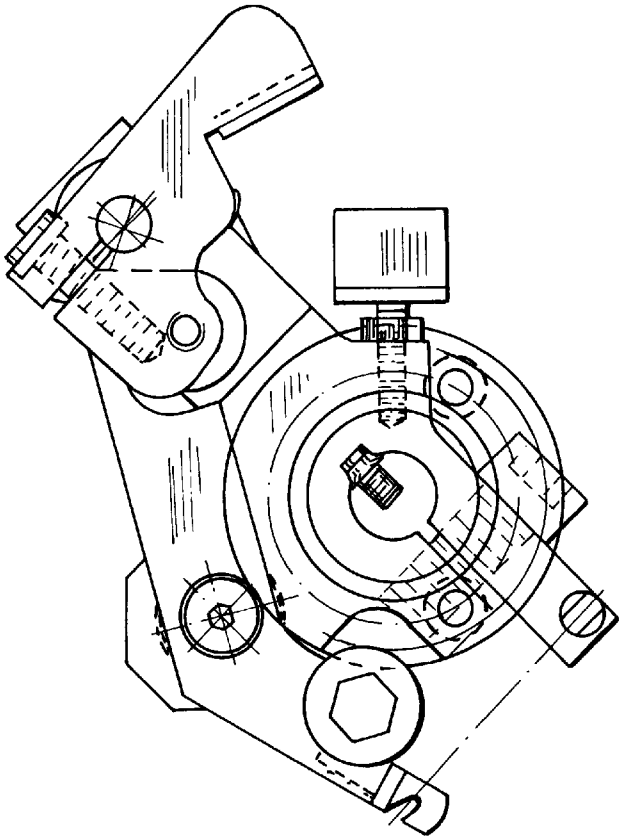
Figure 5:
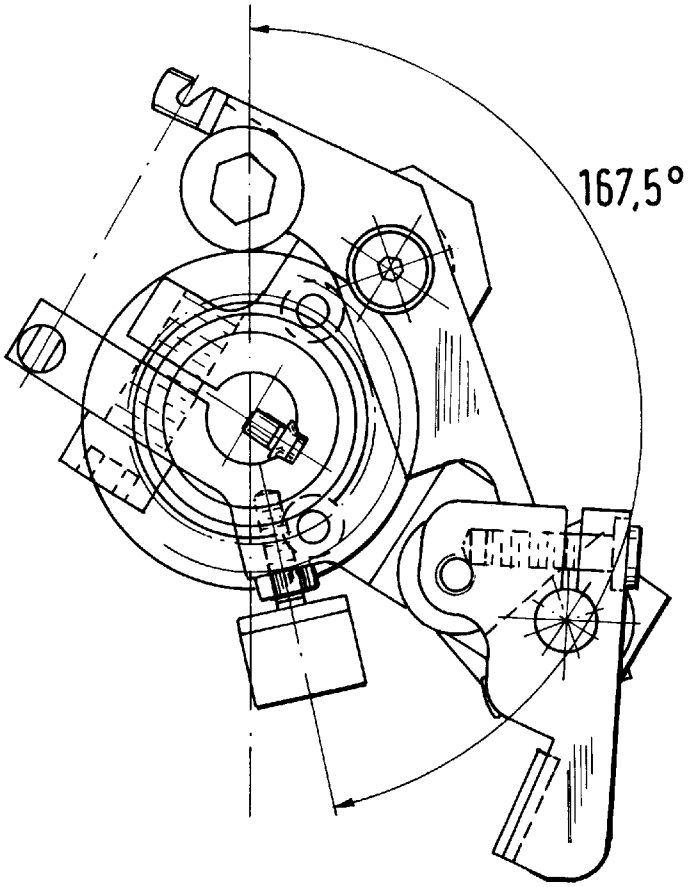
Figure 4:
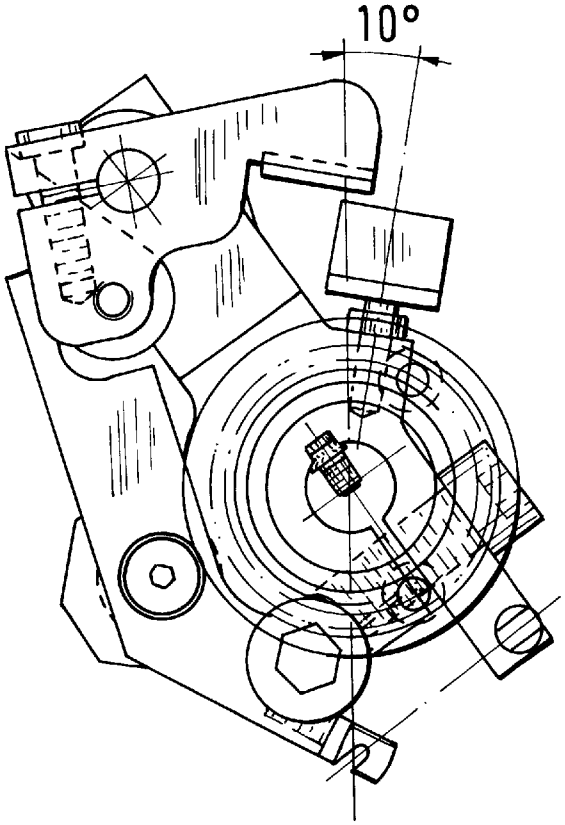

In order that the orientation of the gripper, or rather that of the gripper arm and of the support, with respect to the lid 1*b* being held remains as unchanged as possible during this movement, the gripper as a whole must be swung with respect to the support arm 10. This is achieved by means of an additional toothed belt 32 or the like (for the sake of clarity depicted only in phase II.) running between two rollers not represented in detail, of which rollers the one whose axis coincides with axis 12 is firmly attached to the swing arm 9, and the other whose axis coincides with axis 17 is firmly attached to the gripper body 18. The toothed belt 32 thus produces a forced coupling between the angular positions of the swing arm 9, on the one hand, and those of the gripper body 18 on the other, or, expressed differently, between the progress of the closing process and the position of the gripper. The actual gripping function of the gripper 16, i.e. the swinging movement of the gripper arm 21 in the direction towards the support 19, is controlled by the fact that during the above-described swinging movement of the gripper body the movable roller 25 of the tipping lever 24 rolls on the profiled cam disc 26, which is stationary with respect to the support arm 10. FIGS. 3 through 5 show schematically how the radial distance of the roller 25 from the shaft 17 changes with different swinging positions and how the movement of the tipping lever 24, transferred to the roller 22, controls the position of the gripper arm 21. Here the angle indication "−5°" corresponds approximately to position I. (FIG. 1) and the indication "167.5°" approximately to position III.

As the three movement phases depicted in FIG. 1 clearly show, in this way the position of the gripper body 18, which position can be best followed by observing that of the support 19, remains unchanged with respect to the lid 1*b* during the entire swinging movement. The profile of the mentioned cam disc 26 is here adapted in such a manner that at a position of approximately −5° (FIG. 2) the gripper begins to close (FIG. 3), is completely closed shortly thereafter (FIG. 4), and over the greatest region of the closing swing motion remains in this closed position. Immediately before the setting down of the lid 1*b* onto the lower part of the CD box 1*a*, i.e. shortly before reaching the position indicated by III. in FIG. 1, the gripper opens once again (FIG. 5), so that the gripper arm 21 can withdraw from the region of the CD box and this can be closed completely.

Because of the fact that the gripper arm 21, during virtually the entire closing process, presses the booklet 3 and the lid 1*b* against the support 19 in the described manner, and therewith presses both parts against each other, a slipping of booklet and lid is precluded to the requisite degree owing to the friction between the two parts, with the pressing, or rather, gripping force being adjustable in this implementation example through, for example, a changing of the firmness of the spring tensioning the gripper arm. An obvious and suitable alternative to this would be an automatic control for the gripper movement itself.

As an example of another arrangement of the inventive principle of producing a temporary pressing force between the lid and the booklet, reference is made to the possibility of electrostatically charging at least one of the two parts and utilizing the mutual attractive force for the purpose according to the invention. Here it has proved of advantage to electrostatically charge the booklet immediately before insertion into the lid, with high voltages of some 1000 volts being applied. For example, a comb-like electrode arrangement could be used for charging the booklet, over which arrangement the booklet is moved during the insertion into the lid. The lid of the CD box is here grounded, so that the resulting potential difference provides for a correspondingly strong attractive force. Owing to the large contact surface available between lid and booklet, a satisfactory effect is attained here also, even though the local pressing force is naturally weaker than in the first example.

The features of the invention revealed in the preceding description, in the drawings, as well as in the claims can be essential, both individually and in any combinations whatever, for the realization of the invention in its different implementation forms.

I claim:

1. Process for packaging compact discs (CD's) in CD boxes, each box comprising a lower part and a lid swingably mounted thereon, the process comprising:

opening a CD box;

inserting a booklet into the lid of the CD box; and closing the CD box by swinging back the lid, while temporarily pressing the booklet and the lid firmly against each other to prevent the booklet from slipping with respect to the lid during the closing.

2. Process according to claim 1, comprising pressing the booklet against the lid by pneumatic means.

3. Process according to claim 1, comprising pressing the booklet against the lid by mechanical means.

4. Process according to claim 3, wherein pressing by mechanical means comprises pressing the booklet against the lid with a gripper.

5. Process according to claim 3, wherein pressing by mechanical means comprises pressing the booklet against the lid under magnetic influence.

6. Process according to claim 5, wherein pressing under magnetic influence comprises pressing the booklet against the lid under electromagnetic influence.

7. Process according to claim 1, further comprising electrostatically charging at least one of the booklet and the lid, wherein a resulting electrostatic attractive force presses the bottom and lid firmly against each other.

8. Process according to claim 7, comprising electrostatically charging at least one the booklet and the lid prior to inserting the booklet into the lid.

9. Apparatus for packaging compact discs (CD's) in CD boxes, each box comprising a lower part and a lid swingably mounted thereon, the apparatus comprising:

supply mechanism supplying a CD box;

lid actuating mechanism, opening the CD box and closing it by swinging back the lid;

booklet insertion mechanism inserting a booklet into the lid; and a device temporarily pressing the booklet and the lid firmly against each other while the lid is swung back, to prevent the booklet from slipping with respect to the lid.

10. Apparatus according to claim 9, wherein the device comprises a pneumatic arrangement pressing together the booklet and the lid.

11. Apparatus according to claim 9, wherein the device comprises a mechanical arrangement.

12. Apparatus according to claim 11, wherein the mechanical arrangement comprises a gripper.

13. Apparatus according to claim 11, wherein the device comprises a magnetic arrangement mechanically pressing the booklet and the lid together.

14. Apparatus according to claim 13, wherein the magnetic arrangement comprises an electromagnetic arrangement.

15. Apparatus according to claim 12, wherein the gripper is coupled to the lid actuating mechanism, whereby it is guided in a circular course around a swing axis of the lid during closing.

16. Apparatus according to claim 12, wherein the lid actuating mechanism comprises a support arm guided on two parallel swing arms in parallelogram arrangement, wherein the gripper is guided in a circular course.

17. Apparatus according to claim 12, wherein the lid actuating mechanism comprises a support arm and wherein the gripper is swingably mounted thereon.

18. Apparatus according to claim 17, further comprising a coupling between the swing arm and the gripper, coupling a swing position of the gripper to a position of the swing arm.

19. Apparatus according to claim 17, further comprising a coupling controlling a gripping function of the gripper depending on the gripper's swing position with respect to a support arm of the lid actuating mechanism.

20. Apparatus according to claim 19, wherein in the coupling further comprises a cam disk and a cam follower.

21. Apparatus according to claim 9, further comprising a charger, electrostatically charging the booklet.

22. Apparatus according to claim 21, wherein the charger comprises grounding means for grounding the lid.

23. Apparatus according to claim 21, wherein the charger comprises a comb-electrode arrangement, over which the booklet moves during insertion into the lid.

24. Apparatus according to claim 9, further comprising a charger, electrostatically charging the lid.

25. Apparatus according to claim 9, further comprising a charger, electrostatically charging the booklet with a voltage of about 1000 volts, and for grounding the lid, wherein a resulting potential difference provides an attractive force between the booklet and the lid.

* * * * *